United States Patent [19]

Moss

[11] 4,383,483

[45] May 17, 1983

[54] HYDRAULICALLY-ACTUATED MANDREL FOR A DEMOUNTABLE PRINTING CYLINDER

[75] Inventor: Lester I. Moss, Hackensack, N.J.

[73] Assignee: Mosstype Corporation, Waldwick, N.J.

[21] Appl. No.: 194,616

[22] Filed: Oct. 6, 1980

[51] Int. Cl.[3] ..... B41F 13/10; B41F 13/20

[52] U.S. Cl. ..... 101/375; 29/113 R

[58] Field of Search ..... 101/375, 376; 29/113 R, 29/113 AD, 117, 123, 129, 129.5; 242/72 R, 72 B; 279/2 A; 269/48.1

[56] References Cited

U.S. PATENT DOCUMENTS

| | | | |
|---|---|---|---|
| 1,600,692 | 9/1926 | Millspaugh | 101/375 |
| 2,583,117 | 1/1952 | Piperoux et al. | 29/113 R |
| 2,787,956 | 4/1957 | Kirby et al. | 101/375 |
| 2,797,604 | 7/1957 | Atherholt et al. | 279/4 |
| 2,876,961 | 3/1959 | Cole et al. | 242/72 |
| 2,949,852 | 8/1960 | Schaefer | 101/375 |
| 3,166,013 | 1/1965 | Wyllie et al. | 29/113 R |
| 3,202,432 | 8/1965 | Cameron | 242/72 X |
| 3,217,554 | 11/1965 | Stalker | 29/129.5 X |
| 3,253,323 | 5/1966 | Saueressig | 29/113 R |
| 3,378,902 | 4/1968 | Hoexter | 29/156.4 R |
| 3,388,916 | 6/1968 | Winnen et al. | 279/2 |
| 3,535,760 | 10/1970 | James | 29/113 R |
| 3,762,730 | 10/1973 | Cameron | 242/72 B X |
| 3,770,287 | 11/1973 | Weber et al. | 242/72 |
| 4,050,643 | 9/1979 | Secor | 242/72 R |
| 4,135,677 | 1/1979 | Warczak | 242/72 B |
| 4,147,312 | 4/1979 | Secor et al. | 242/72 R |
| 4,150,622 | 4/1979 | Stollenwerk et al. | 29/113 R X |
| 4,217,821 | 8/1980 | Vertegaal | 101/375 X |

FOREIGN PATENT DOCUMENTS

| | | | |
|---|---|---|---|
| 2815892 | 9/1979 | Fed. Rep. of Germany | 29/113 R |

*Primary Examiner*—J. Reed Fisher

*Attorney, Agent, or Firm*—Michael Ebert

[57] ABSTRACT

A mandrel assembly for a demountable printing cylinder, the assembly including a tube receivable within the cylinder and having journals joined thereto at either end. Encircling each journal is an expansible sleeve, the sleeves fitting within the end heads of the cylinder when it is mounted on the mandrel assembly. Below each sleeve is a relieved journal zone defining an annular hydraulic chamber. A lateral bore in each journal receives a piston and a tool-operated piston screw, the bore leading into an internal duct having branches communicating with the hydraulic chamber. When the piston screw is turned in to advance the piston, the resultant hydraulic pressure is applied through the hydraulic chamber against the inner wall of the sleeve, causing the sleeve to expand and grip the cylinder head thereby locking the cylinder to the mandrel assembly. When the piston screw is turned out, the pressure is released to permit removal of the cylinder.

5 Claims, 6 Drawing Figures

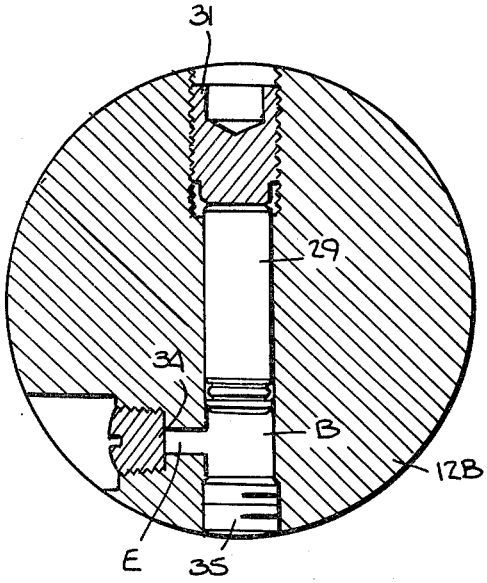
Fig. 4.
Fig. 5.
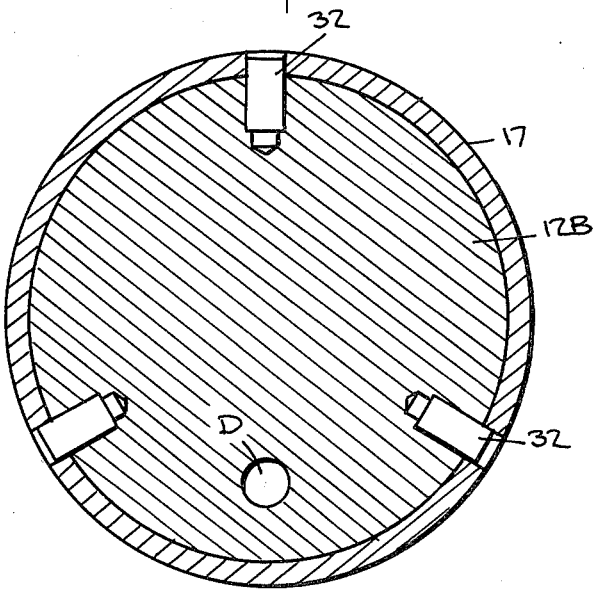
Fig. 6.
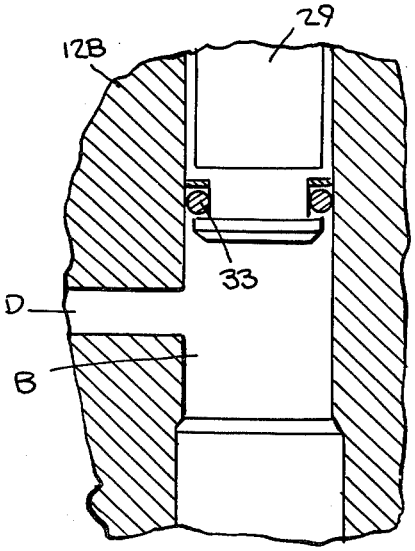

HYDRAULICALLY-ACTUATED MANDREL FOR A DEMOUNTABLE PRINTING CYLINDER

BACKGROUND OF THE INVENTION

This invention relates generally to demountable printing cylinders, and more particularly to a mandrel assembly for supporting a demountable cylinder and including a pair of hydraulically-actuated sleeves which are expansible to engage the end heads of the cylinder to lock the cylinder to the mandrel assembly.

In gravure printing, use is made of a printing cylinder whose surface is etched with cup-like cells which, as the cylinder passes through an ink fountain, pick up and carry the ink. When the cylinder engages an impression roller, the ink is transferred to the surface of the paper running therebetween. Flexographic printing uses similar inks, but the ink is picked up by rubber printing plates attached to a cylinder.

Since in the course of such printing operations, it is frequently necessary to replace one cylinder by another, various expedients have heretofore been proposed to provide demountable cylinder structures whereby the same mandrel may be coupled to different cylinders for use in the printing machine.

The simplest mechanical expedient for this purpose is set-screws to attach a cylinder to the mandrel. While set-screw arrangements are uncomplicated, they have many serious practical drawbacks. It is difficult to achieve proper concentricity with set screws; and as a consequence, the printing is of poor quality. Moreover, set-screws tend to vibrate and work loose. Other more complicated mechanical locking devices, such as split-lock clamping collars and expanding collets, have been suggested, but these are generally more expensive and equally inaccurate.

One may obtain accurate mounting for printing cylinders using a heat-shrinkage procedure to attach and detach a cylinder to or from a mandral. This procedure involves end closures on the cylinder having a relatively high coefficient of thermal expansion with respect to the mandrel, and it requires special heating equipment. Not only is the procedure time-consuming, but should axial or side-to-side adjustment of the cylinder on the mandrel be necessary, the heating procedure must be repeated with a further loss of time.

Another known approach makes use of hydraulically-actuated collet locks for demountable cylinders. However, known devices of this type require grease guns to pump fluid into the lock each time a locking action is to be effected, the grease being bled off each time the mandrel is to be released. The use of grease in the enviornment of printing operations is obviously undesirable. Moreover, it is not possible with such known devices to determine, without the use of additional expedients, the amount of hydraulic pressure that is being imposed on the mandrel, and whether it is sufficient to afford adequate torque resistance. As a consequence, cylinder creep or slippage may be encountered in the course of printing, with deleterious effect.

The Hoexter patent 3,378,902 discloses a printing cylinder having a pair of hydraulically-actuated collets mounted at opposing ends thereof, the mandrel for supporting the cylinder being slidably receivable within the collets and securely locked thereto when hydraulic pressure is applied. Each collet includes a cylindrical sleeve having a thick-walled hub section and a relatively long thin-walled pressure section. A broad circumferential channel is cut in the pressure section to form a bendable pressure wall, the pressure section being surrounded by a collar of high tensile strength whose edges are welded to the pressure section to define an annular fluid chamber bounded by the collar and the pressure wall.

A pressure cartridge is fitted into a cavity in the hub section, the cartridge communicating with the fluid chamber in the pressure section and including a piston which is advanced inwardly by an adjusting screw. When the annular chamber is filled with hydraulic fluid and the piston is advanced inwardly, the resultant hydraulic pressure causes flexure of the pressure wall, thereby subjecting the mandrel to radially-directed stresses which are uniformly distributed and serve to lock the mandrel to the collet and at the same time to maintain proper concentricity.

In the Hoexter arrangement, the mandrel is a standard shaft, but the demountable cylinder is not of standard design. It is a special cylinder which includes a pair of hydraulically-actuated end collets, as described above. Hence the special cylinder is substantially more expensive to manufacture than a standard cylinder. Since each machine in the printing facility is provided with several special cylinders each operable with a common mandrel, the overall cost of this arrangement is high.

SUMMARY OF THE INVENTION

In view of the foregoing, the main object of this invention is to provide a mandrel assembly for use with standard demountable printing cylinders, the assembly being hydraulically-actuated to engage the end heads of the cylinder and lock it to the mandrel assembly.

More specifically, an object of this invention is to provide a mandrel assembly of the above type having a pair of quick-acting hydraulically-actuated expansible sleeves adapted to produce a uniform outward pressure throughout its circumference to engage the end heads of a printing cylinder, whereby distortion of the cylinder is avoided and proper concentricity is maintained.

A significant feature of the invention resides in a self-sufficient and sealed hydraulic system mandrel assembly which produces a cylinder locking action by turning a piston screw, a release action being obtained simply by reversing the direction of turn, no external source of hydraulic fluid being required.

Also an object of the invention is to provide a hydraulically-actuated mandrel assembly for demountable printing cylinders which makes it possible to use low cost cylinders of conventional design.

Briefly stated, these objects are attained in a mandrel assembly for a demountable printing cylinder having end collets, the assembly including a tube, the tube having journals joined thereto and extending therefrom at either end. Encircling each journal adjacent the tube end is an expansible sleeve whose normal dimensions are such that the sleeve fits neatly within the corresponding end collet of the printing cylinder.

A zone on each journal below the sleeve is relieved to define an annular hydraulic chamber. Formed in the journal in a region adjacent the sleeve is a lateral bore within which is received a piston and a piston screw which when turned in causes the piston to advance toward an internal duct filled with hydraulic fluid and extending longitudinally into the journal, the duct having lateral branches which communicate with the hydraulic chamber.

When the piston is caused to advance, hydraulic pressure is applied through the hydraulic chamber to the inner wall of the sleeve to effect circumferential expansion thereof, causing the sleeve to grip the associated collet and thereby lock the cylinder to the mandrel assembly.

OUTLINE OF DRAWINGS

For a better understanding of the invention as well as other objects and further features thereof, reference is made to the following detailed description to be read in conjunction with the accompanying drawings, wherein:

FIG. 4 is a transverse section taken in the plane indicated by lines 4—4 in FIG. 2;

FIG. 5 is an enlargement of the head of the piston shown in FIG. 3; and

FIG. 6 is an enlarged detail showing the annular hydraulic chamber defined in a journal of the mandrel assembly.

DESCRIPTION OF INVENTION

Figure 1:
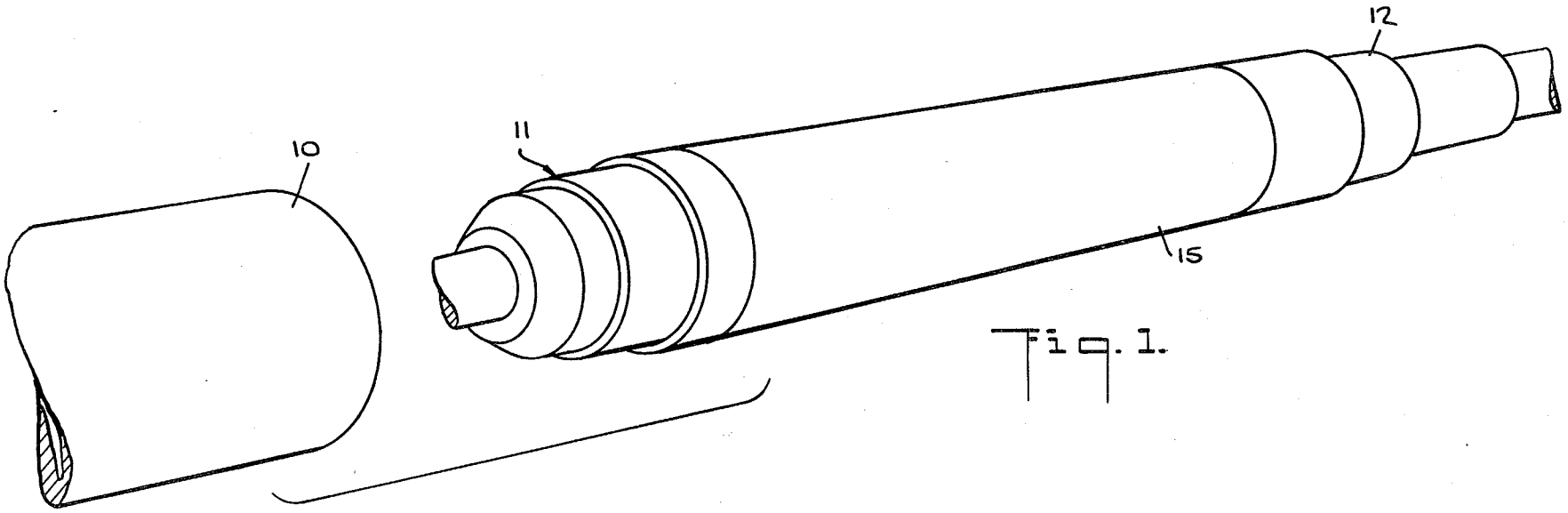
FIG. 1 is a perspective view of a standard printing cylinder mountable on a mandrel assembly in accordance with the invention.
Figure 3:
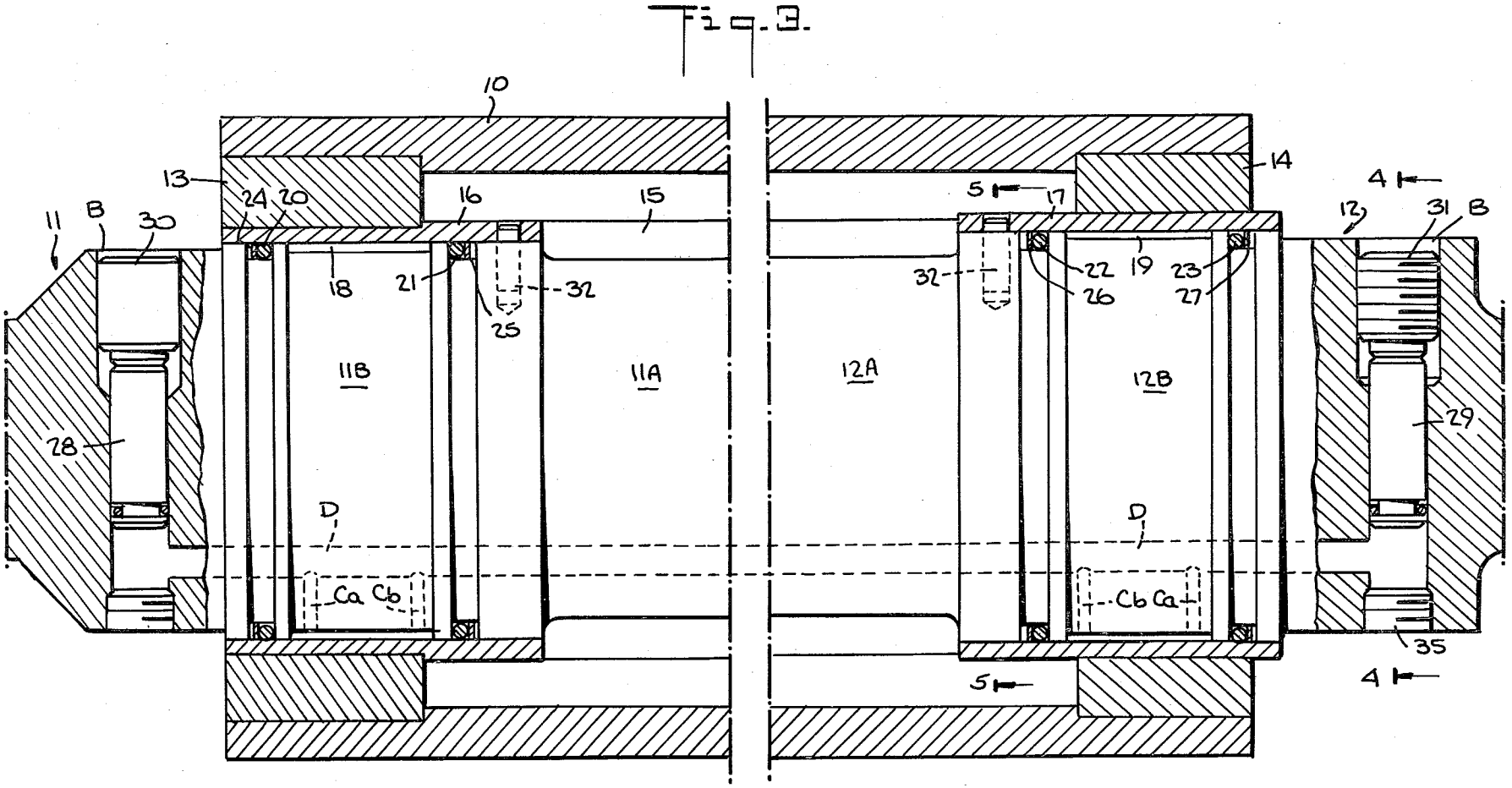
FIG. 3 is a tranverse section taken in the plane indicated by lines 3—3 in FIG. 2.

Referring now to FIG. 1, there is shown a gravure or flexographic printing cylinder 10 releasably mounted on a mandrel assembly in accordance with the invention supported for rotation within a printing press, the assembly including left and right journals 11 and 12 which are received in suitable bearings in the printing machine for which it is intended. Cylinder 10 is of standard design and is of uniform circular cross section. As best seen in FIG. 3, cylinder 10 is provided with annular end heads 13 and 14 provided with circular bores.

Journals 11 and 12 each include a leading section (11A and 12A, respectively) which is shrunk-fit into the opposite ends of a metal supporting tube 15. Thus the mandrel assembly is composed of three pieces, tube 15 and journals 11 and 12 joined to either end and extending axially therefrom.

Figure 2:
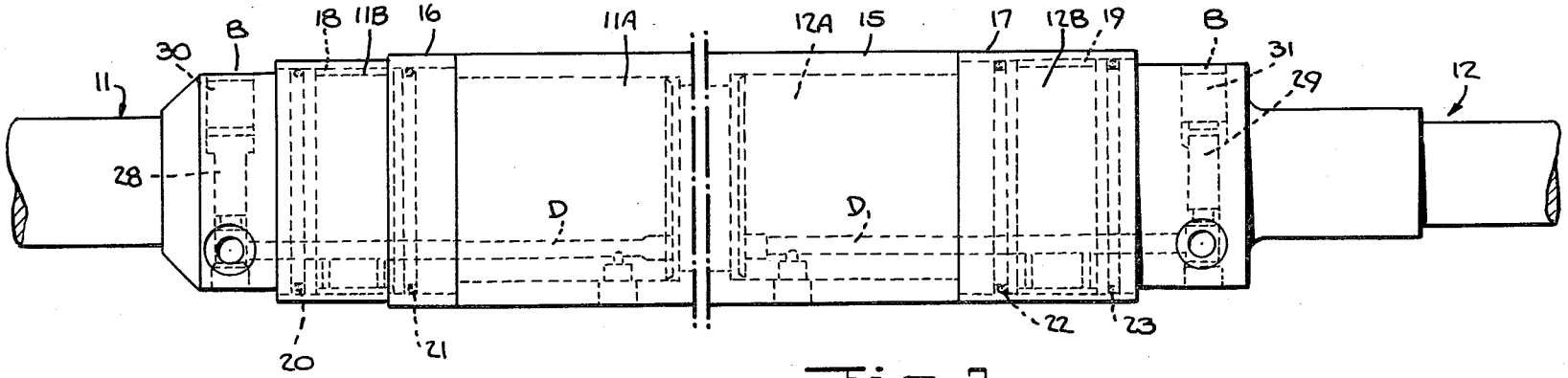
FIG. 2 is a longitudinal section of the assembly.

Journals 11 and 12 are provided with an intermediate section 11B and 12B, respectively, the portion of this section which adjoins the end of the tube being encircled by an expansible sleeve. Thus left journal 11 is provided with a sleeve 16, and right journal 12 with a sleeve 17, the sleeve being preferably made of steel. The parameters are such that the outside diameter of the sleeves in the unexpanded state is substantially equal to that of the end collet in which it is received; hence the cylinder is readily mounted thereover, as shown in FIG. 2. The length of the mandrel assembly measured from sleeve to sleeve is about equal to the length of the printing cylinder. Hence when the cylinder is mounted, sleeves 16 and 17 lie within end collets 13 and 14, respectively, of the cylinder.

The intermediate sections 11B and 12B are machined to relieve a zone underlying sleeves 16 and 17 to define annular hydraulic chambers 18 and 19. On either side of these chambers, annular grooves are formed which, in the case of journals 11 and 12, are occupied by O-rings 20 to 23, these rings providing seals preventing oil leakage when the sleeves are expanded. In each of these grooves, there is also a back-up ring, rings 24, 25, 26 and 27 being provided for this purpose.

As best seen in FIG. 5, sleeve 17 is retained in journal section 12B by a set of three pins 32, sleeve 16 being similarly pinned to journal section 11B.

In intermediate sections 11B and 12B at a position adjacent sleeves 18 and 19, there is a lateral bore B to accommodate pistons 28 and 29, respectively. Bore B is terminated by a plug 35. Piston 28 is advanced in its bore by means of a socket set screw 30 which is normally turnable by a dog or a similar tool, the screw engaging the foot of the piston. Piston 29 is advanced in its bore by means of a socket screw 31. Bore B leads into an internal duct D extending longitudinally through the journal, the duct being filled with hydraulic fluid.

Duct D communicates through lateral branches $C_a$ and $C_b$ with annular hydraulic chambers 18 and 19 in the journals. As best seen in FIGS. 4 and 6, piston 29, which operates within lateral bore B in journal section 12B, is provided at its front face with an O-ring 3 which lies within an annular groove below the face, the ring serving to prevent leakage of hydraulic fluid into the lateral bore along the slide path of the piston. A similar arrangement is provided for piston 28.

To permit bleed of the hydraulic fluid, duct B, as shown in FIG. 4, is provided with a lateral duct E which leads to the exterior of journal section 12B and is sealed by a removable plug 34. A similar bleed arrangement is provided in journal section 11B.

Thus when cylinder 10 is fitted over the three-piece mandrel assembly formed by tube 15 and journals 11 and 12, the end head 13 of the cylinder is received on sleeve 16 and the end head 14 on sleeve 17. In order to lock the cylinder to the mandrel assembly, one has merely by means of a suitable tool to turn in piston screws 30 and 31 on either side of the cylinder. This action forces hydraulic fluid into chambers 18 and 19, respectively, and causes sleeves 16 and 17 to expand uniformly, the expansion causing the sleeves to engage and grip the end collets of the cylinder and thereby securely hold cylinder 10 onto the mandrel assembly.

If one wishes to replace printing cylinder 10 with another cylinder, all that is necessary is to turn out piston screws 30 and 31 to release the hydraulic pressure, causing the sleeves to revert to their normal unexpanded state and permitting the removal of cylinder 10.

While there has been shown and described a preferred embodiment of a hydraulically-actuated mandrel for a demountable printing cylinder in accordance with the invention, it will be appreciated that many changes and modifications may be made therein without, however, departing from the essential spirit thereof.

I claim:

1. The combination of a mandrel assembly and a standard printing cylinder supported thereby in a printing machine having bearings, said cylinder having annular heads fitted therein at each end said heads projecting radially inward from the inner surface of the cylinder, each head being provided with a circular bore, said cylinder, being demountable on said assembly, said assembly comprising:

A. a tube receivable within said cylinder;

B. respective journals joined to opposing ends of the tube and extending axially therefrom for insertion in said machine bearings, a respective journal having an expansible metal sleeve pinned thereon whose normal dimensions are such that the respective said sleeve fits into the bore of a respective end head of the cylinder, each said sleeve surrounding an annular hydraulic chamber formed on each of said journal, said chamber communicating through an internal duct filled with hydraulic fluid to a lateral bore in each said journal adjacent one end of said tube, each journal having a leading section which is shrunk fit into an end of said tube and an intermediate section which is surrounded by said sleeve and is relieved to define said annular hydraulic chamber; and C. a piston received in each said lateral bore whose foot is engaged by a piston screw and whose face subjects said fluid to pressure, whereby when said screw is turned in, the resultant pressure is transmitted by the fluid to the respective said sleeve to effect expansion thereof, causing the respective said sleeve to grip said end head.

2. An assembly as set forth in claim 1, wherein said intermediate section has grooves formed on either side of said chamber to accommodate "O" rings to effect a seal preventing leakage of said fluid when said sleeve is expanded.

3. An assembly as set forth in claim 2, wherein said sleeve is fabricated of steel.

4. An assembly as set forth in claim 1, wherein said duct is formed longitudinally in said intermediate section and is provided with lateral branches which communicate with said chamber.

5. An assembly as set forth in claim 4, wherein said bore is provided with a fluid bleed duct leading to the exterior of the journal and sealed by a removable plug.

* * * * *